US008499525B1

(12) United States Patent
Meixner

(10) Patent No.: US 8,499,525 B1
(45) Date of Patent: Aug. 6, 2013

(54) DISPLAY WALL STANDARD/FRAMING MEMBER

(76) Inventor: William Meixner, Ventura, CA (US)

( * ) Notice: Subject to any disclaimer, the term of this patent is extended or adjusted under 35 U.S.C. 154(b) by 0 days.

(21) Appl. No.: 13/457,956

(22) Filed: Apr. 27, 2012

Related U.S. Application Data

(60) Provisional application No. 61/610,706, filed on Mar. 14, 2012.

(51) Int. Cl.
*E04B 1/00* (2006.01)
*E04G 21/00* (2006.01)
*E04G 23/00* (2006.01)

(52) U.S. Cl.
USPC ..... 52/741.15; 52/481.1; 52/27; 52/474; 52/475.1; 52/349; 52/461; 52/842; 52/846; 52/844; 248/200; 248/220.21; 248/242; 211/87.01; 211/90.01

(58) Field of Classification Search
USPC ..... 52/713, 712, 714, 715, 481.2, 481.1, 52/478, 364, 349, 220.8, 474, 475.1, 476, 52/299, 243, 241, 293.3, 279, 278, 282.4, 52/836, 845, 842, 846, 848, 741.15, 290, 52/238, 461, 844, 27; 248/243, 220.21, 200, 248/242, 153; 211/87.01, 90.01, 153, 187
See application file for complete search history.

(56) References Cited

U.S. PATENT DOCUMENTS

| | | | | | |
|---|---|---|---|---|---|
| 2,375,513 | A * | 5/1945 | Bach | 248/59 |
| 3,332,197 | A * | 7/1967 | Hinkle | 52/844 |
| 3,609,933 | A * | 10/1971 | Jahn et al. | 52/461 |
| 4,108,915 | A * | 8/1978 | Rosback et al. | 585/828 |
| 4,205,815 | A * | 6/1980 | Sauer et al. | 248/243 |
| 4,988,008 | A * | 1/1991 | Blum et al. | 211/189 |
| 5,146,723 | A * | 9/1992 | Greenwood et al. | 52/288.1 |
| 5,325,641 | A * | 7/1994 | Felton | 52/36.4 |
| 5,493,834 | A * | 2/1996 | Nelson | 52/349 |
| 5,592,796 | A * | 1/1997 | Landers | 52/241 |
| 5,692,341 | A * | 12/1997 | Erlandson | 52/27 |
| 5,697,507 | A * | 12/1997 | Blass | 211/94.01 |
| 5,913,788 | A * | 6/1999 | Herren | 52/241 |
| 5,924,256 | A * | 7/1999 | Ito | 52/481.1 |
| 5,927,041 | A * | 7/1999 | Sedlmeier et al. | 52/836 |
| 6,314,687 | B1 * | 11/2001 | Schondelmayer et al. | 52/63 |
| 7,712,267 | B2 * | 5/2010 | Lehane et al. | 52/169.5 |
| 8,132,376 | B2 * | 3/2012 | Pilz et al. | 52/207 |

* cited by examiner

*Primary Examiner* — Chi Q Nguyen
(74) *Attorney, Agent, or Firm* — Sandy Lipkin

(57) ABSTRACT

A wall standard designed to attach to standard steel construction studs with self-tapping framing screws in the front and on the side of the device at predetermined spacings.

3 Claims, 3 Drawing Sheets

DISPLAY WALL STANDARD/FRAMING MEMBER

REFERENCE TO PRIOR APPLICATION

This application claims the priority of provisional application 61/610,706, filed Mar. 14, 2012 entitled DISPLAY WALL STANDARD/FRAMING MEMBER by William Meixner.

BACKGROUND OF THE INVENTION

1. Field of the Invention

The present invention relates generally to the field of wall framing and specifically toward a display wall standard/framing member that is inexpensive, adaptable and easy to ship and install.

2. Description of the Prior Art

In the field of construction and specifically in the step of framing, wall standards are used to provide a means to attach brackets, shelves, panels or any mountable object to a wall. Existing devices are heavy and bulky, supplied in lengths up to fourteen feet. The instant invention seeks to provide a simple one-piece device that can be applied in any framing job by incorporating metal studs.

SUMMARY OF THE INVENTION

The preferred embodiment of the present invention teaches a metal wall standard for the attachment thereon of brackets, panels or any mountable object to a wall comprising: a front face panel having a first end and a second end, said first end and said second end having a top side and a bottom side wherein side top side and said bottom side extend across the top of said front face panel and across the bottom of said front face panel thereby creating a top to said face panel and a bottom to said face panel; a bottom base extending away from said front face panel in a substantially perpendicular direction that then curves upward creating a J shape; a top capping portion that extends away from said front face panel and then curves downward creating a substantially J shape that is designed to wrap around the top of a wall wherein a lip portion extends away from said substantially J shape thereby creating a lip that is attachable to metal studs; a series of vertical slots extending along said front face panel substantially in a row wherein said vertical slots are separated by spaces for the inclusion of spot welds.

The above embodiment can be further modified by defining that a spot weld angle is placed on the surface opposing said front face panel between said front face panel and said metal stud.

The above embodiment can be further modified by defining that metal screws secure said front face panel and said lip to said metal stud.

BRIEF DESCRIPTION OF THE DRAWINGS

This invention can better be understood by reference to the drawings, provided for exemplary purposes, and in which.

DETAILED DESCRIPTION OF A PREFERRED EMBODIMENT

Figure 1:
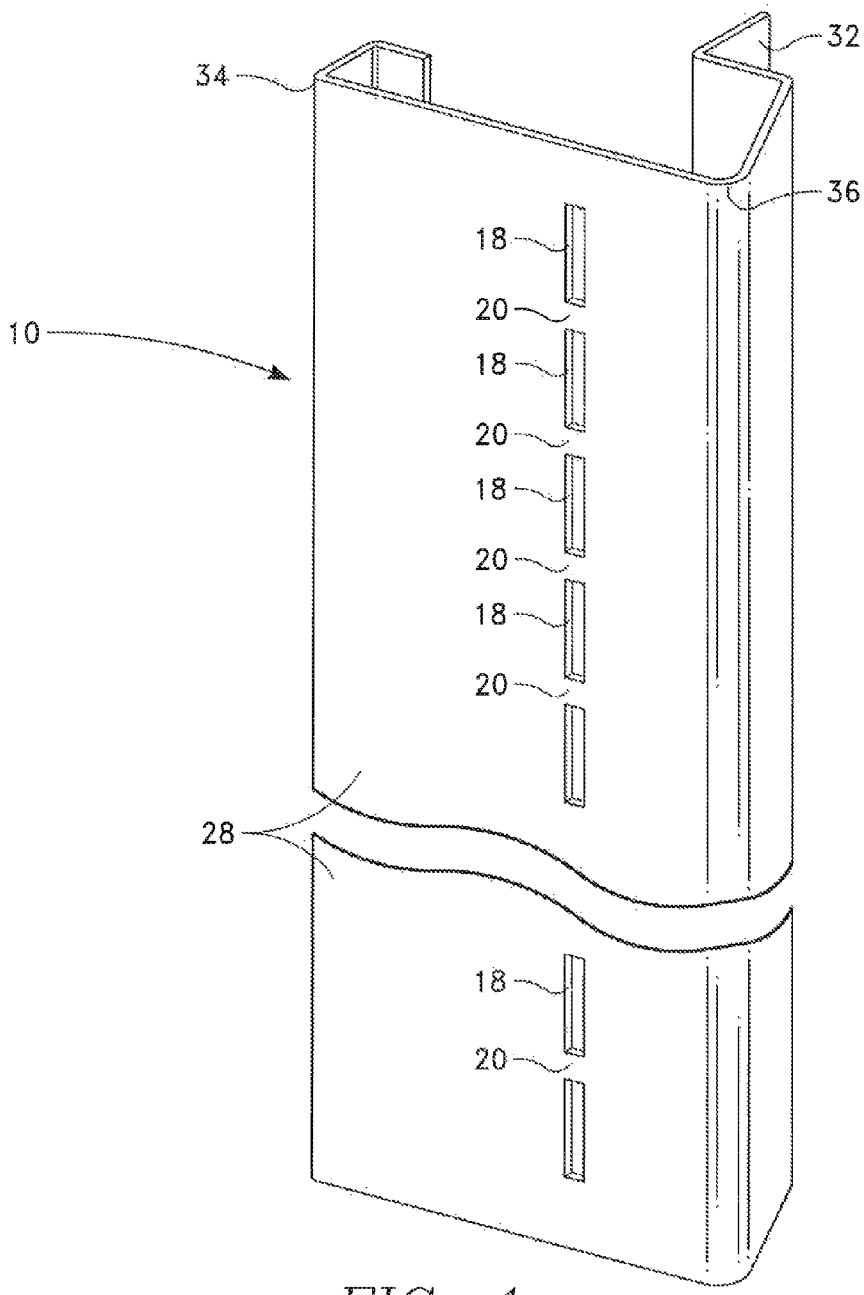
FIG. 1 is a perspective view of the face of the device.

The instant invention provides a metal wall standard 10 to attach brackets, shelves, panels or any mountable object 38 to a wall 12. The wall standard 10 is made to attach to standard steel construction studs 14 with self-tapping framing screws 16 in the front and on the side at a predetermined space. The standard 10 has vertical slots 18 ⅛" to ⅝" with a ⅜" space 20 between as normal. However, other sizes and spacings are also possible within the scope of this invention.

The device 10 is designed for retail displays, but is not limited to that use. In the preferred embodiment it uses a lightweight rolled, formed and/or stamped sheet meet that can be 18 ga. or 20 ga. with an 18 ga. spot welded angle 22. It can be installed on any standard metal stud 14 from 1⅝" up to 6", but is designed to install on standard 3⅝" 20 ga. metal studs 14 of any height.

When installed on a standard metal stud 14 it will combine the strength of both members for an excellent load capacity. It will be preferably manufactured on 8 foot lengths making it lightweight, inexpensive and easy to ship. The one piece device 10 is combined with metal studs 14 that are appropriate the specific framing job.

When attaching ½" or ⅝" gypsum board 24, all that will be needed is standard "J" mould 26 that is found at any material supplier, along with metal studs.

Figure 3:
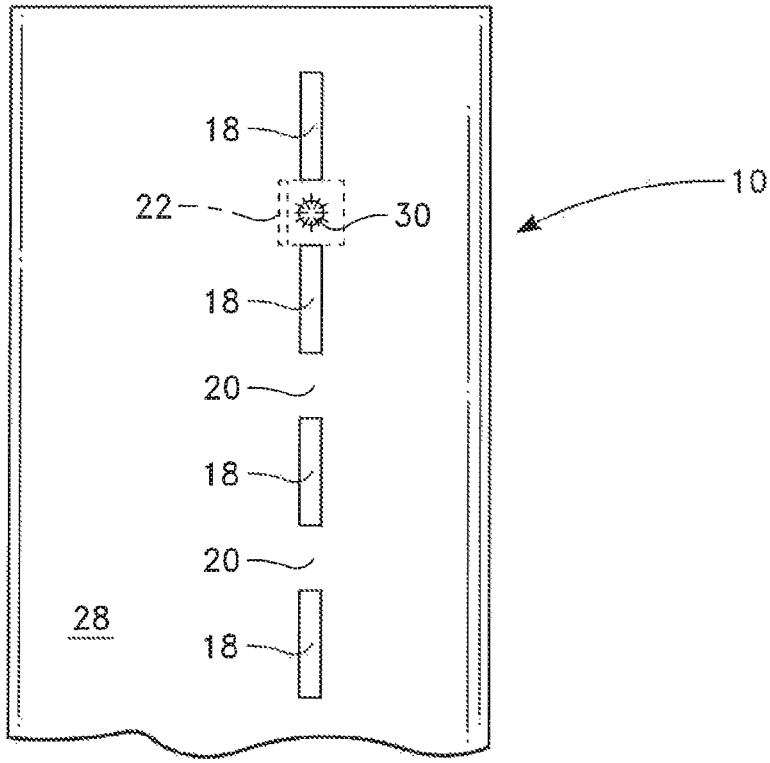
FIG. 3 is cut out of FIG. 1 and shows how the standard slots and spacing on the spot welds hold standard angles in place.

FIG. 1 shows a perspective view of the device 10 that could be any length, but that is preferably limited to 8 foot pieces that can be multiplied to create a larger area. The device 10 includes a front face 28 that has vertical slots 18 substantially in a row with spaces 20 between. As seen in FIG. 3, these spaces 20 allow space for the spot welds 30 for the placement thereon of the angle 22.

Figure 2:
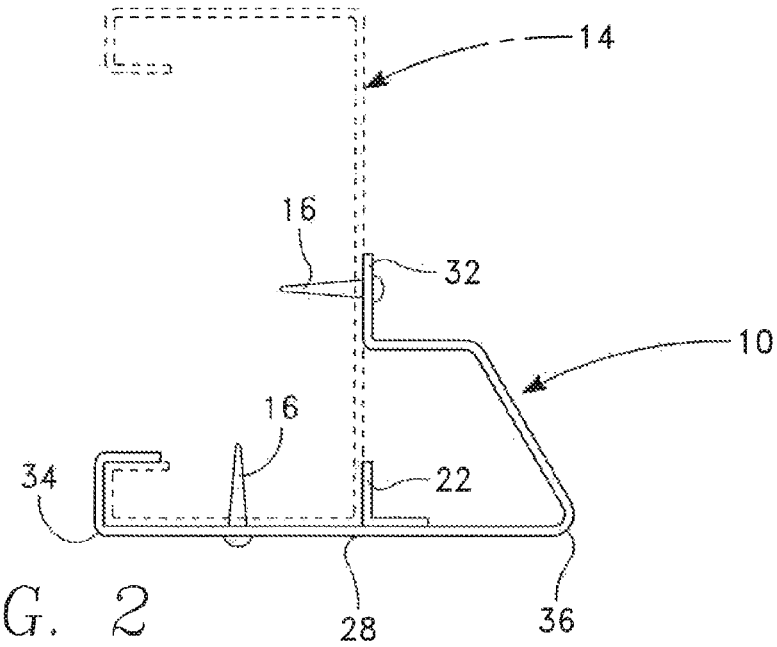
FIG. 2 shows a side view of the device as it attaches to a typical metal stud.

FIG. 2 shows a side view of the device 10. In this view the metal stud 14 is visible whereon the device is mounted. The device is secured on the front face 28 with a screw 16 and on the attaching lip 32. The front face 28 has a first side 34 that forms a "J" shape to correspond to the shape of the metal stud 14. The face 28 has a second side 36 that curves around the top of the framed wall that curves around to the attaching lip 32 that is then secured to the metal stud 14 with a screw 16.

Figure 4:
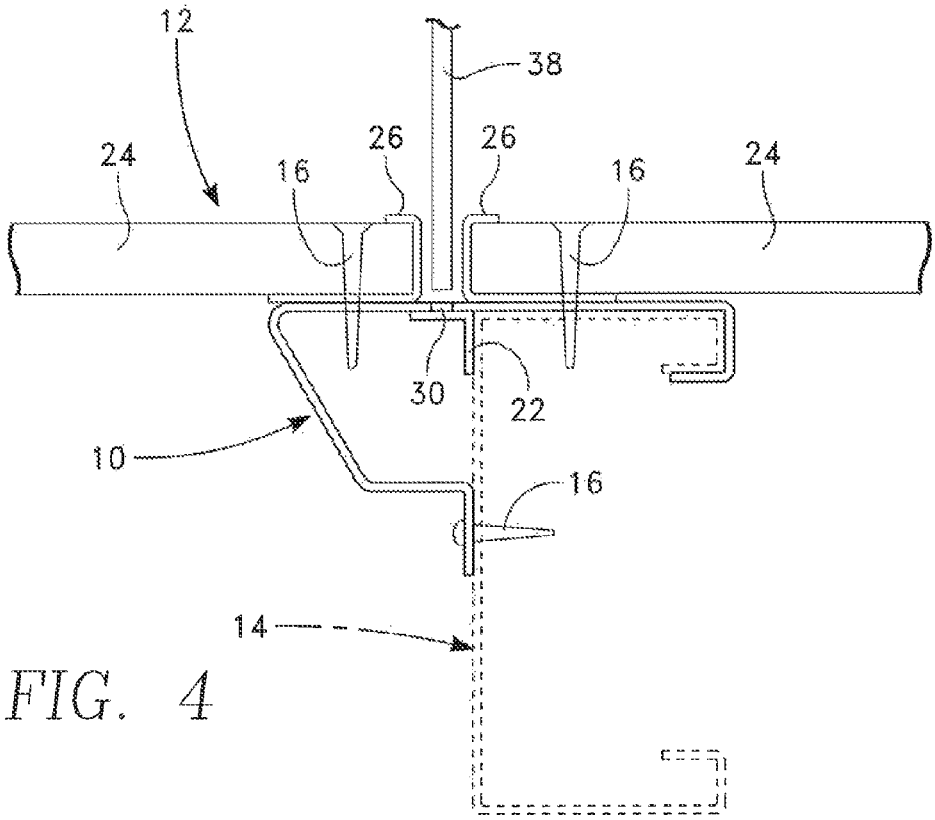
FIG. 4 a side view of the device as it attaches to gypsum board using common "J" metal.
Figure 5:
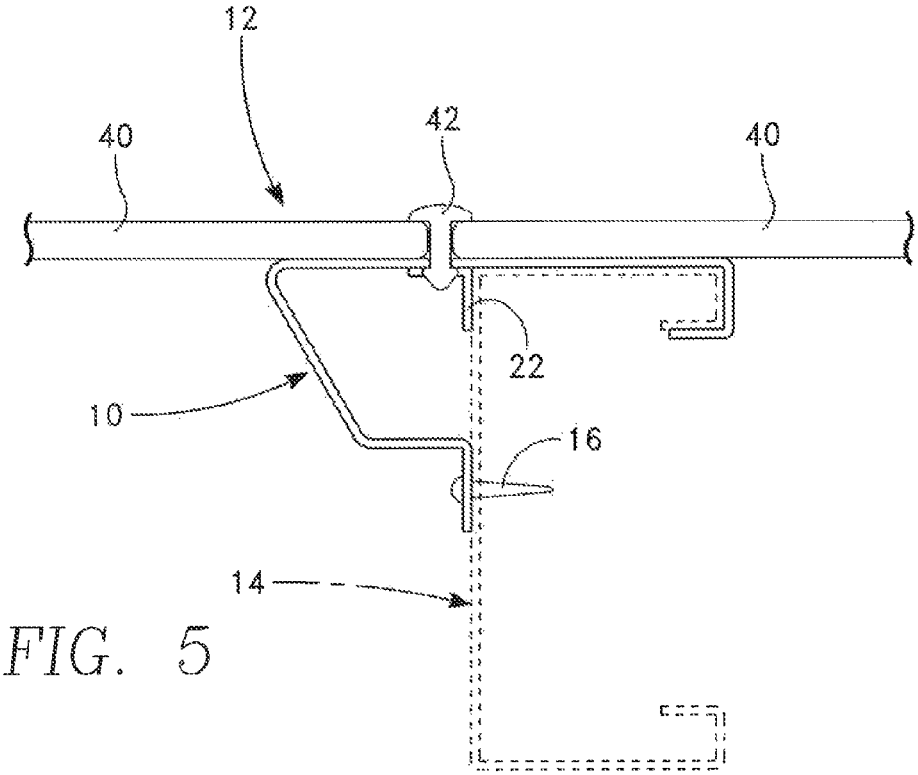
FIG. 5 is the same side view as in FIG. 4 but with hardboard panels attached with clips.

FIG. 4 shows the device 10 in use with gypsum board 24 and J metal mould 26. A bracket 38 is seated between the gypsum board 24 and the J mold 26 and attaches to the spot weld angle 22. FIG. 5 shows the device 10 in use attaching hardboard panels 40 to the spot weld angle 22 and held in place with a clip 42.

The illustrations and examples provided herein are for explanatory purposes only and are not intended to limit the scope of the appended claims. This disclosure is to be considered an exemplification of the principles of the invention and is not intended to limit the spirit and scope of the invention and/or claims of the embodiment illustrated. Those skilled in the art will make modifications to the invention for particular applications of the invention.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A method of constructing a shelf standard in metal framing for the attachment thereon of brackets, panels or any mountable object to a wall comprising the steps of:

obtaining a singular member being oriented in a vertical direction;

attaching said singular member to a vertical stud wherein said singular member further comprises:

a front face panel having a top side and a bottom side, said top side and said bottom side attaching to a first side and a second side wherein said first side and said second side extend vertically down the length of said front face panel;

a first side flange extending away from said front face panel in a substantially perpendicular direction that then curves in a second perpendicular direction back towards said front face thereby creating a first substantially J shape;

a second side flange portion that extends away from said front face panel and then curves away from said front face thereby creating a second substantially J shape;

a lip portion that extends away from said second side flange portion;

a series of vertical slots extending along said front face panel substantially in a row wherein said vertical slots are separated by spaces for the inclusion of spot welds wrapping said second side flange portion around a side of said vertical stud and attaching thereto through said lip portion.

2. The method as defined in claim 1 wherein a spot weld angle is placed on a surface opposing said front face panel between said front face panel and said vertical stud.

3. The method as defined in claim 1 wherein metal screws secure said front face panel and said lip to said vertical stud.

* * * * *